US006120319A

United States Patent [19]

Lee et al.

[11] Patent Number: 6,120,319

[45] Date of Patent: Sep. 19, 2000

[54] IDC CONNECTOR

[75] Inventors: George Lee, Taipei; Kuei-Chang Hsu, Long-Tan; Yen-Chao Tsai, Pan-Chiao, all of Taiwan

[73] Assignee: Hon Hai Precision Ind. Co., Ltd., Taipei Hsien, Taiwan

[21] Appl. No.: 09/251,038

[22] Filed: Feb. 18, 1999

[30] Foreign Application Priority Data

| | | | |
|---|---|---|---|
| Feb. 18, 1998 | [TW] | Taiwan | 87202332 |
| Mar. 18, 1998 | [TW] | Taiwan | 87202333 |
| May 14, 1998 | [TW] | Taiwan | 87207438 |

[51] Int. Cl.[7] ..... H01R 12/24; H01R 4/24

[52] U.S. Cl. ..... 439/497; 439/405

[58] Field of Search ..... 439/101, 677, 439/374, 680, 108, 608, 513, 517, 497, 404, 402, 405

[56] References Cited

U.S. PATENT DOCUMENTS

| | | | |
|---|---|---|---|
| 4,143,935 | 3/1979 | Goodman et al. | 339/99 R |
| 5,100,215 | 3/1992 | Cooke et al. | 312/257 |
| 5,409,396 | 4/1995 | Bowen | 439/465 |
| 5,885,093 | 3/1999 | Champion et al. | 439/101 |
| 5,893,773 | 4/1999 | Dellinger | 439/404 |

*Primary Examiner*—Lincoln Donovan
*Assistant Examiner*—Chandrika Prasad
*Attorney, Agent, or Firm*—Wei Te Chung

[57] ABSTRACT

An IDC connector comprises a dielectric housing having mating and connecting faces and an array of passageways defined therebetween. A pair of retaining wedges is formed on opposite ends of the housing. An array of ground and signal terminals is alternately assembled within the array of passageways and each terminal includes an insulation displacement section extending beyond the mating face and a connecting portion received within the passageway. A flat cable having a plurality of ground and signal wires is electrically terminated to the insulation displacement sections of the terminals, respectively. A cover is assembled to the mating face of the housing for attaching the flat cable to the insulation displacement sections extending from the mating face. The cover forms a pair of latches on opposite ends thereof for engagement with the wedges. A grounding device having at least a pair insulation displacement sections electrically connects two conductive wires terminated to the ground terminals.

4 Claims, 4 Drawing Sheets

IDC CONNECTOR

FIELD OF THE INVENTION

The present invention relates to an insulation displacement contact (hereinafter referred to as IDC connector, and more particularly to an IDC connector having a grounding device for ensuring reliable signal transmission unaffected by cross talk.

1. Description of Prior Art

Flat cables are widely used to connect a subsystem to a computer system, i.e. between a CD-ROM and a motherboard. The flat cable generally comprises a plurality of wires assembled in a side-by-side arrangement. Each wire includes a conductor enclosed with insulative layer. The flat cable is generally connected to insulation displacement sections of an IDC connector because the pitch between two adjacent wires is too small to connect one by one. The connector includes a cover which pushes each wire toward a connection end of a terminal assembled within the connector and electrically connects the conductor with the connection end. U.S. Pat. Nos. 4,190,952, 4,508,401, 4,596,428, and 4,749,371 disclose such flat cables.

In order to facilitate high speed signal transmission between the system and subsystems, the flat cable increases the number of wires within the existing configuration. However, the pitch between two adjacent wires is reduced to a minimum and a cross talk or interference will occur, thereby adversely affecting signal transmission. In assembly, each wire must be accurately aligned with a corresponding insertion end to ensure a reliable electrical connection therebetween. Any therebetween will result in an improper or incomplete electrical connection. Nevertheless, the conventional connector does not include a device to ensure accurate alignment between the wire and the insertion end.

Because the pitch between two adjacent conductive wires is too small to create the cross talk, the designation of signal transmission in the flat cable is arranged in a pattern of GND-SGN-GND-SGN-GND (wherein GND is an abbreviation of ground, and SGN is an abbreviation of signal) thereby eliminating the cross talk effect by interposing a ground wire between two adjacent signal wires. However, those ground signal wires are independent from each other. If the ground wires can be grounded together, the signal transmission can be further ensured. In addition, in some application some signal wires need to be grounded and an additional grounding device shall be provided to meet the requirement.

2. Summary of the Invention

An objective of this invention is to provide an IDC connector having a grounding device for facilitating high-speed high quality signal transmission.

In order to achieve the objective set forth, an IDC connector in accordance with the present invention comprises a dielectric housing having mating and connecting faces and an array of passageways defined therebetween. A pair of retaining wedges is formed on opposite ends of the housing. An array of ground and signal terminals is alternately assembled within the array of passageways and each terminal includes an insulation displacement section extending beyond the mating face and a connecting portion received within the passageway. A flat cable having a plurality of ground and signal wires is electrically terminated to the insulation displacement sections of the terminals. A cover is assembled to the mating face of the housing for attaching the flat cable to the insulation displacement sections extending from the mating face. The cover forms a pair of latches on opposite ends thereof for engagement with the wedges. A grounding device having at least a pair insulation displacement sections electrically connects two conductive wires terminated to the ground terminals.

These and additional objects, features, and advantages of the present invention will become apparent after reading the following detailed description of the preferred embodiments of the invention taken in conjunction with the appended drawing.

DETAILED DESCRIPTION OF PREFERRED EMBODIMENTS

Figure 1:
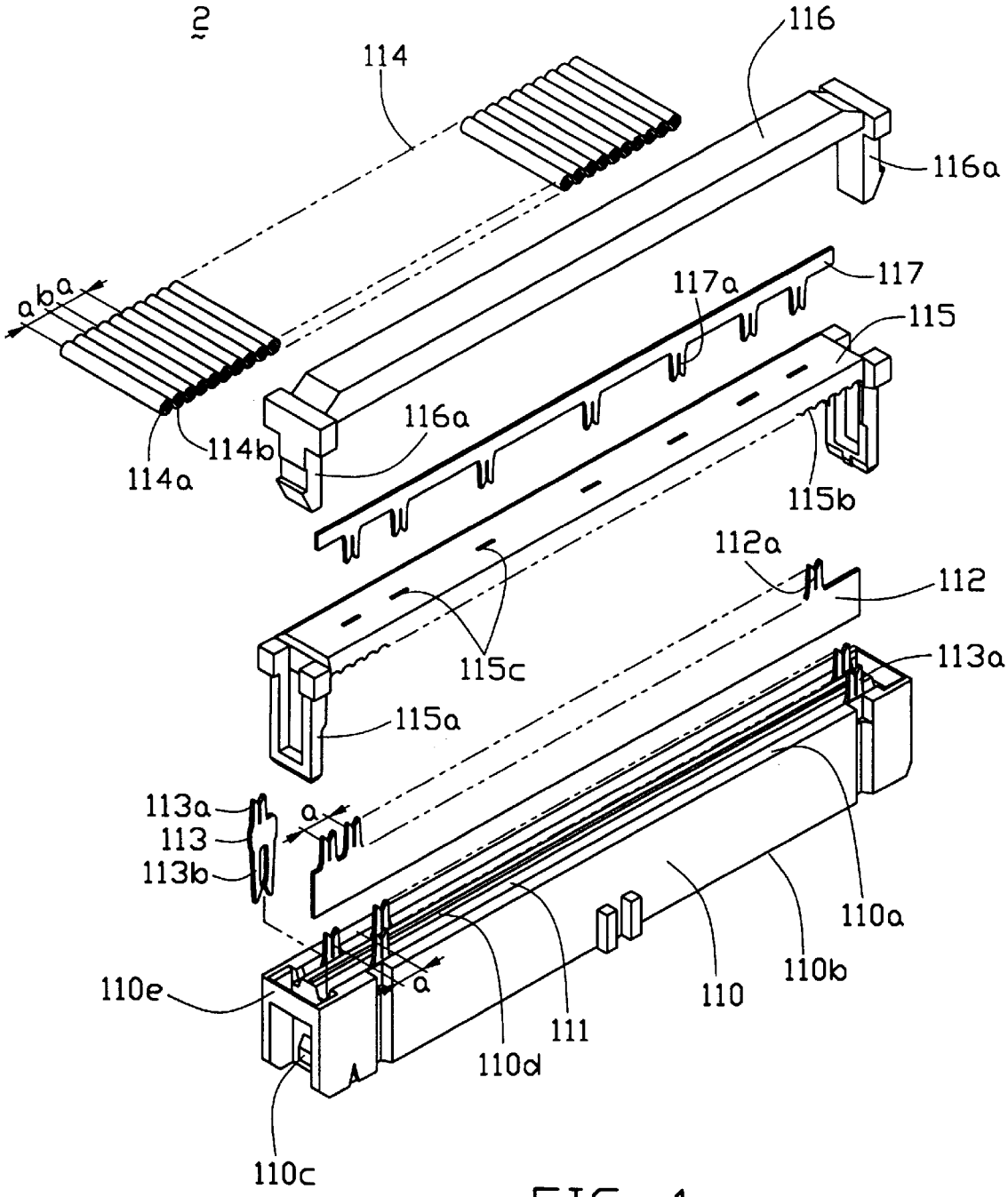
FIG. 1 is a perspective view of an IDC connector in accordance with a first embodiment of the invention.
Figure 2:
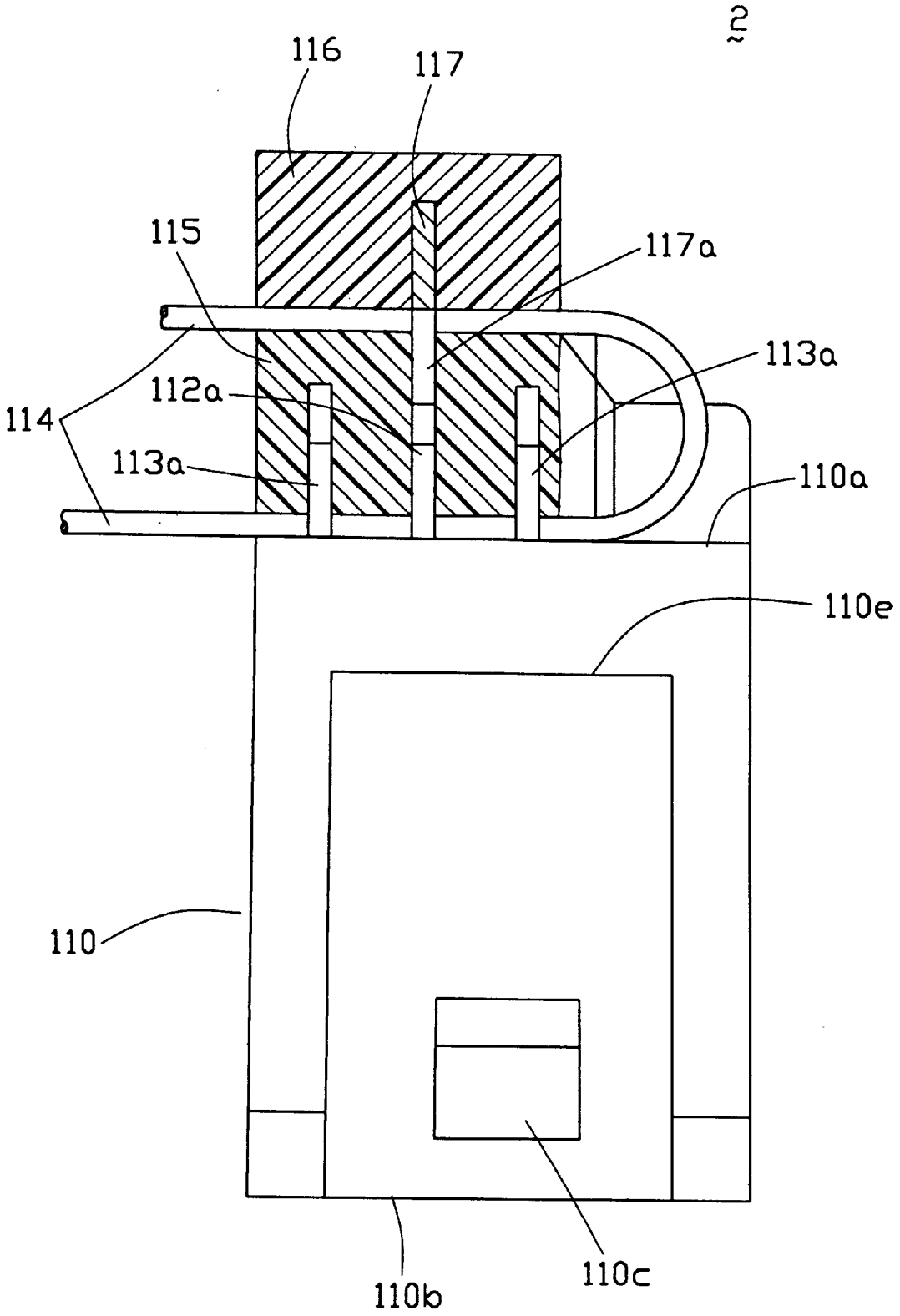
FIG. 2 is a cross section view of FIG. 1.

Referring to FIGS. 1 and 2, an IDC connector 2 in accordance with a first embodiment of the present invention comprises a dielectric housing 110 having mating and connecting faces 110*a*, 110*b* and an array of passageways 111 defined therebetween. A pair of retaining wedges 110*c* is formed on opposite ends of the housing 110. An elongate slot 110*d* is defined between the passageways 111 and a first grounding device which embodies as a grounding strip 112 is assembled therein. The first grounding strip 112 forms a plurality of insulation displacement sections 112*a* extending upward. An array of signal terminals 113 is alternately assembled within the passageways 111 and each terminal 113 includes an insulation displacement section 113*a* extending beyond the mating face 110*a* and a connecting portion 113*b* received within the passageway 111. A flat cable 114 has a plurality of ground and signal wires 114*a*, 114*b* electrically terminated to the insulation displacement sections 113*a* of the terminals 113. A cover 115 is assembled to the mating face 110*a* of the housing 110 for facilitating termination of the flat cable 114 to the insulation displacement sections 113*a* of the terminals 113 and the insulation displacement sections 112*a* of the first grounding strip 112. The cover 115 forms a pair of latches 115*a* on opposite ends thereof for engagement with the wedges 110*c* when the cover 115 is assembled to the housing 110. The cover 115 defines a plurality of recesses 115*b* at a bottom surface thereof for positioning the individual conductive wires 114*a*, 114*b* therein.

A strain relief 116 is assembled to the housing 110 and includes a pair of hooks 116*a* formed on opposite ends thereof. The hooks 116*a* are engaged to latches 110*e* formed above the wedges 110*c* of the housing 110. The strain relief 116 further defines an elongate slot (not shown) to retain a second grounding strip 117 therein. The second ground strip 117 forms a plurality of insulation displacement sections 117*a* extending downward. The insulation displacement sections 117*a* may extend into slits 115*c* defined in the cover 115. When the strain relief 116 is assembled to the housing 110, a plurality of selected ground and signal 114*a* and 114*b* thereto are terminated to insulation displacement sections 117*a* of the second ground strip 117 thereby achieving the same result as the first embodiment.

Figure 3:
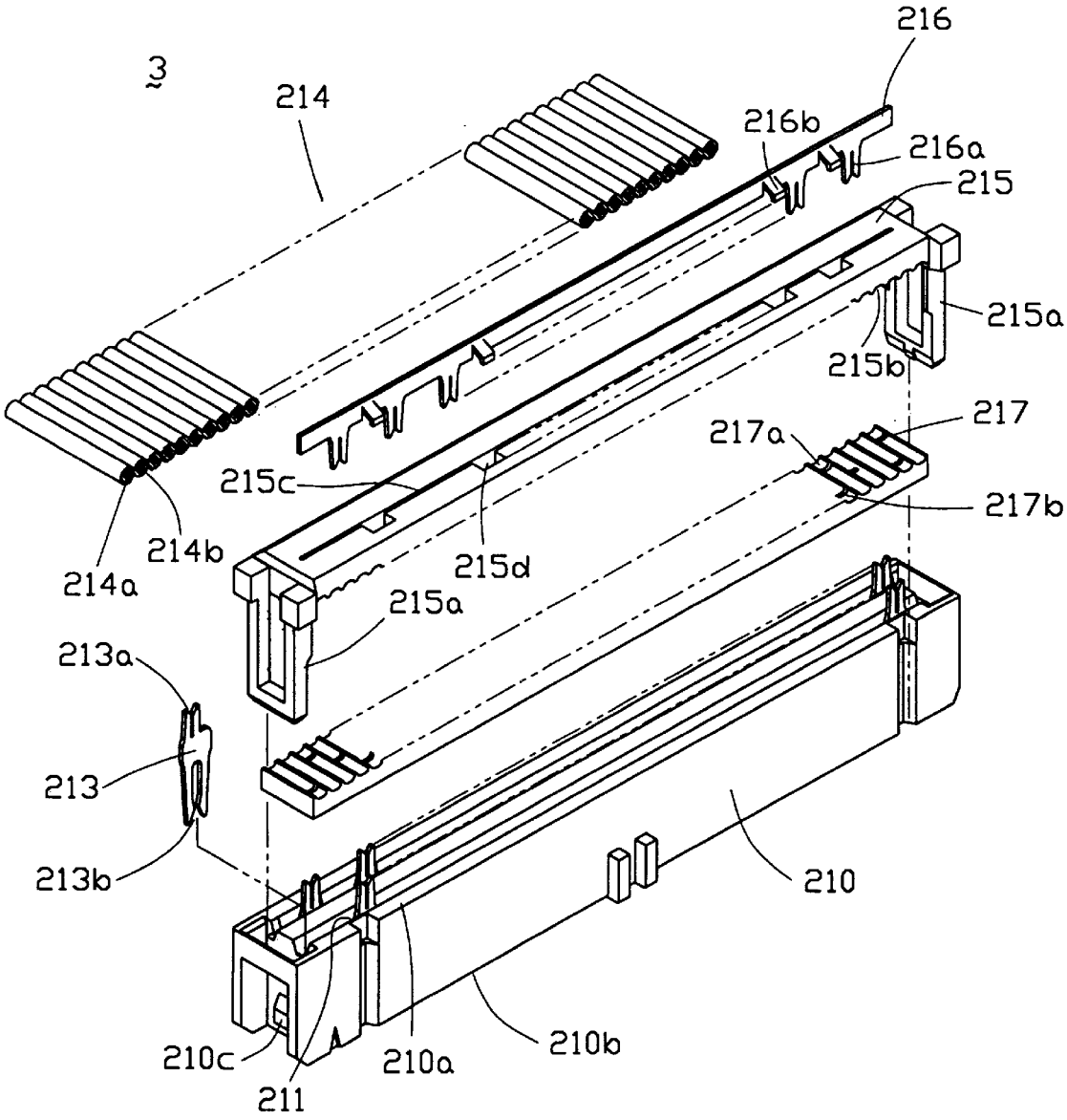
FIG. 3 is a perspective view of an IDC connector in accordance with a second embodiment of the invention.
Figure 4:
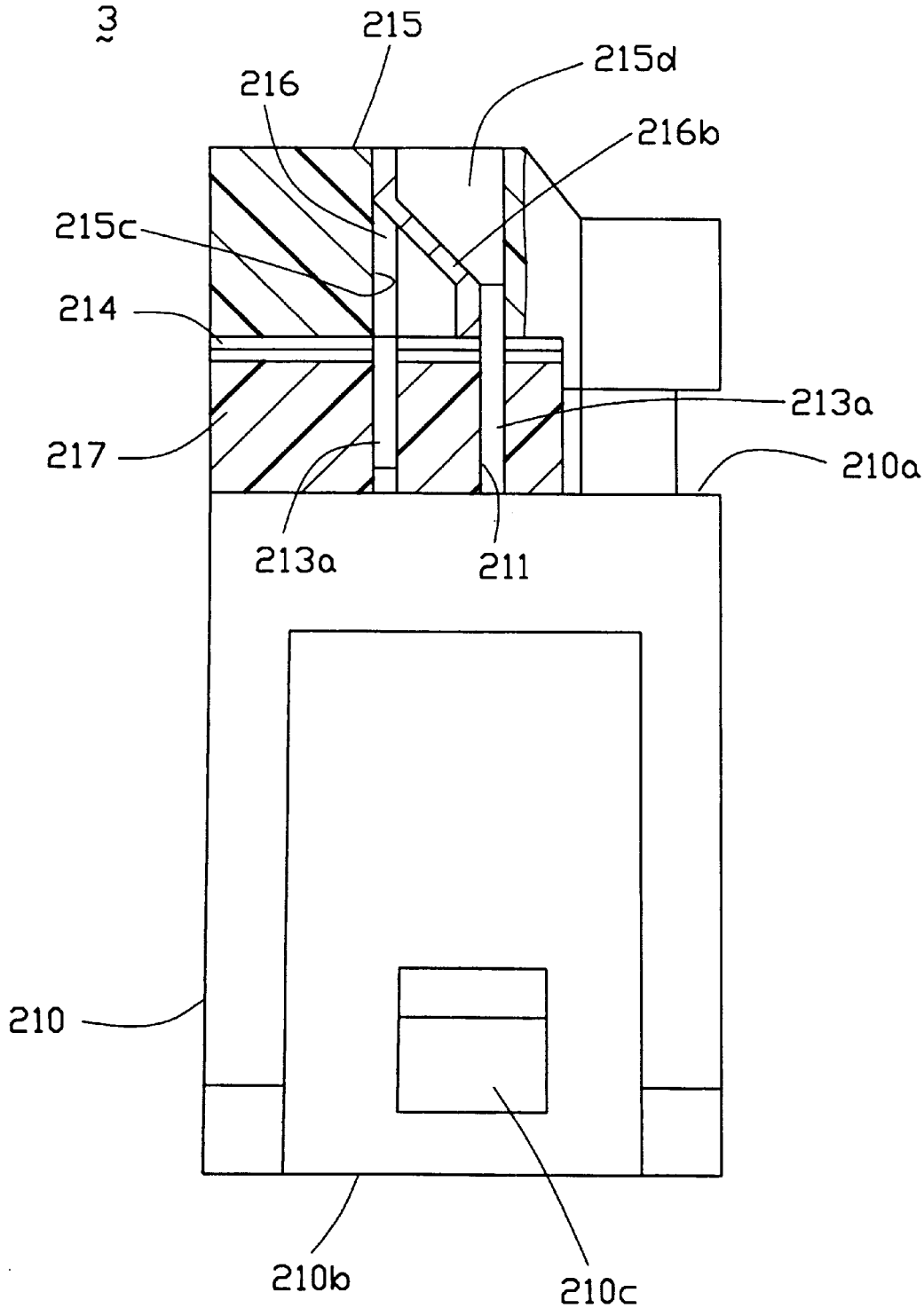
FIG. 4 is a cross section view of FIG. 3.

Referring to FIGS. 3 and 4, an IDC connector 3 in accordance with a second embodiment of the present invention comprises a dielectric housing 210 having mating and connecting faces 210*a,* 210*b* and an array of passageways 211 defined therebetween. A pair of retaining wedges 210*c* is formed on opposite ends of the housing 210. An array of signal terminals 213 is alternately assembled within the passageways 211 and each terminal 213 includes an insulation displacement section 213*a* extending beyond the mating face 210*a* and a connecting portion 213*b* received within the passageway 211. A flat cable 214 has a plurality of ground and signal wires 214*a,* 214*b* electrically terminated to the insulation displacement sections 213*a* of the terminals 213 insulation displacement sections 216*a* of a grounding strip 216. A cover 215 is assembled to the mating face 210*a* of the housing 210 for facilitating termination of the flat cable 214 to the insulation displacement sections 213*a* of the terminals 213. The cover 215 forms a pair of latches 215*a* on opposite ends thereof for engagement with the wedges 210*c* when the cover 215 is assembled to the housing 210. The cover 215 defines a plurality of recesses 215*b* at a bottom surface thereof for positioning the individual conductive wires 214*a,* 214*b* therein. The cover 215 further defines an elongate slot 215*c* therethrough. The elongate slot 215*c* further defines a plurality of cells 215*d* in communication with the elongate slot 215*c*. The grounding device which embodies as a grounding strip 216 is assembled into the elongate slot 215*c*. The grounding strip 216 forms a plurality of insulation displacement sections 216*a* extending downward whereby the ground conductive wires 214*a* are terminated thereto. The grounding strip 216 further forms a plurality of spring arms 216*b* corresponding to the cells 215*d*. The position of the cells 215*d* correspond to some insulation displacement sections 213*a* of selected signal terminals 213. By this arrangement, when the cover 215 is assembled to the housing 210, those selected signal terminals 213 are grounded by the grounding strip 216.

In addition, a spacer 217 having a plurality of recesses 217*a* is assembled to the mating face 210*a* of the housing 210. The spacer 217 includes a plurality of slits 217*b* correspond to the insulation displacement sections 213*a* and 216*a*. By this arrangement, the conductive wires 214 are accurately positioned between the cover 215 and the spacer 217 and the termination between the conductive wires 214 and the insulation displacement sections 213*a* can be smoothly performed.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

We claim:

1. An IDC connector, comprising:

a dielectric housing having mating and connecting faces and an array of passageways defined therebetween, a pair of retaining wedges formed on opposite ends of said housing;

an array of signal terminals alternatively assembled within said array of passageways, each terminal including an insulation displacement section extending beyond said mating face and a connecting portion received within said passageway;

a flat cable having a plurality of ground and signal wires for electrically connection with said insulation displacement sections of said terminals;

a cover assembled to said mating face for said housing for attaching said flat cable to said insulation displacement sections extending from said mating face, said cover forming a pair of latches on opposite ends thereof for engagement with said wedges;

receiving means defined in said housing;

a first grounding strip received in said receiving means and having at least a plurality of insulation displacement sections for electrically terminating said grounding conductive wires;

a strain relief assembled to said cover for securely retaining said flat cable thereto; and a second grounding strip assembled to said strain relief and having at least a plurality of insulation displacement sections for respectively terminating said ground conductive wires and at least a selected signal terminal.

2. An IDC connector as recited in claim 1, wherein said receiving means is an elongate slot defined in said cover.

3. An IDC connector assembly comprising:

a dielectric housing having mating and connecting faces and an array of passageways defined therebetween;

an array of signal terminals alternately assembled with said array of passageways, each of said terminal including an insulation displacement section extending beyond said mating face and a connecting portion received within the corresponding passageway;

a flat cable having a plurality of alternately arranged ground and signal wires;

a cover assembled to said mating face of said housing for attaching said flat cable to the insulation displacement section of each terminal; and a grounding device assembled to said cover having a plurality of insulation displacement sections, wherein ground and signal wires of said flat cable are respectively grounding to said insulation displacement sections of grounding device and said insulation displacement sections of said signal terminals by said cover wherein means for further grounding some of the signal is integrally formed with said grounding device and mechanically and electrically contacts said some of the signal terminals.

4. An IDC connector as recited in claim 3, wherein said grounding device includes a first grounding strip assembled to an elongate slot defined in said cover.

* * * * *